US005439066A

United States Patent [19]

Gipson

[11] Patent Number: 5,439,066

[45] Date of Patent: Aug. 8, 1995

[54] METHOD AND SYSTEM FOR DOWNHOLE REDIRECTION OF A BOREHOLE

[75] Inventor: Thomas C. Gipson, Cisco, Tex.

[73] Assignee: Fleet Cementers, Inc., Cisco, Tex.

[21] Appl. No.: 266,011

[22] Filed: Jun. 27, 1994

[51] Int. Cl.[6] ..... E21B 7/04

[52] U.S. Cl. ..... 175/61; 175/62; 175/77; 175/81; 166/50; 166/77; 166/117.6

[58] Field of Search ..... 175/61, 62, 77, 81; 166/50, 77, 117.6, 387

[56] References Cited

U.S. PATENT DOCUMENTS 4,527,639 7/1985 Dickinson et al. ..... 166/50 X
4,673,035 6/1987 Gipson ..... 166/77
5,163,515 11/1992 Tailey et al. ..... 166/50 X

*Primary Examiner*—Roger J. Schoeppel
*Attorney, Agent, or Firm*—Gunn, Lee & Miller

[57] ABSTRACT

A method and system for translating the orientation of a length of coil tubing from a generally vertical orientation to a generally horizontal orientation, inside a well borehole and downhole of a wellhead. A first conduit is installed and suspended in a well borehole. The conduit is provided with a coil tubing bender at the downhole end of the conduit. Coil tubing is injected into the conduit through an upper packer attached to the top section of the conduit. After a section of coil tubing is injected into the conduit, an outer coil tubing seal is securely affixed to the coil tubing. The coil tubing is run to the top of the bender; the packer is closed; and high pressure fluid is introduced between the upper packer and the outer seal inside the conduit. The fluid forces the coil tubing through the bender and translates the coil tubing from a vertical to horizontal orientation. Abrasive fluid may be pumped at high pressures through the coil tubing now in the horizontal orientation, thereby creating a horizontal bore in the formation.

11 Claims, 4 Drawing Sheets

METHOD AND SYSTEM FOR DOWNHOLE REDIRECTION OF A BOREHOLE

BACKGROUND OF THE INVENTION

The present invention relates to a method and system for use downhole inside a well casing to reorient or redirect a vertical bore to a horizontal bore. More particularly an apparatus is disclosed which may be fitted into a well casing enabling an operator on the surface to turn coil tubing downhole, in a short radius, 90° from the vertical to form a horizontal bore through the well bore itself and into the production zone of the well.

Currently, boring horizontally into the subterranean formation; and more particularly still, in an oil production zone requires expensive and complicated equipment. Translating a vertical bore to a horizontal bore generally requires forty or more feet of bending or curving radius. There has long been a need to be able to create a short radius, 90-degree turn so that horizontal penetration into the production zone may be achieved. The present invention meets this long standing need by providing an inexpensive, labor-saving method for making not only a short radius 90-degree turn but doing it inside an existing well bore, thereby translating or reorienting the vertical base to a generally horizontal bore.

SUMMARY OF INVENTION

The present invention is a system and method for translating the orientation of a length of coil tubing from a generally vertical orientation to a generally horizontal orientation inside a well borehole and downhole of a wellhead and for providing a means of creating a horizontal borehole within the formation. The present invention further provides for the creation of a horizontal bore on a very short radius, in the range of less than one foot, within the well bore. A series of radically extending horizontal bores may be provided by merely redirecting the bender exit and re-initiating the boring operation. Horizontal bores at varying depths within the formation may be achieved with the present invention.

BRIEF DESCRIPTION OF THE DRAWINGS

In describing the invention in detail, reference is had to the accompanying drawings, forming a part of this specification, and wherein like numerals of reference indicate corresponding parts throughout the several views in which.

DETAILED DESCRIPTION OF THE PREFERRED EMBODIMENT

Figure 1:
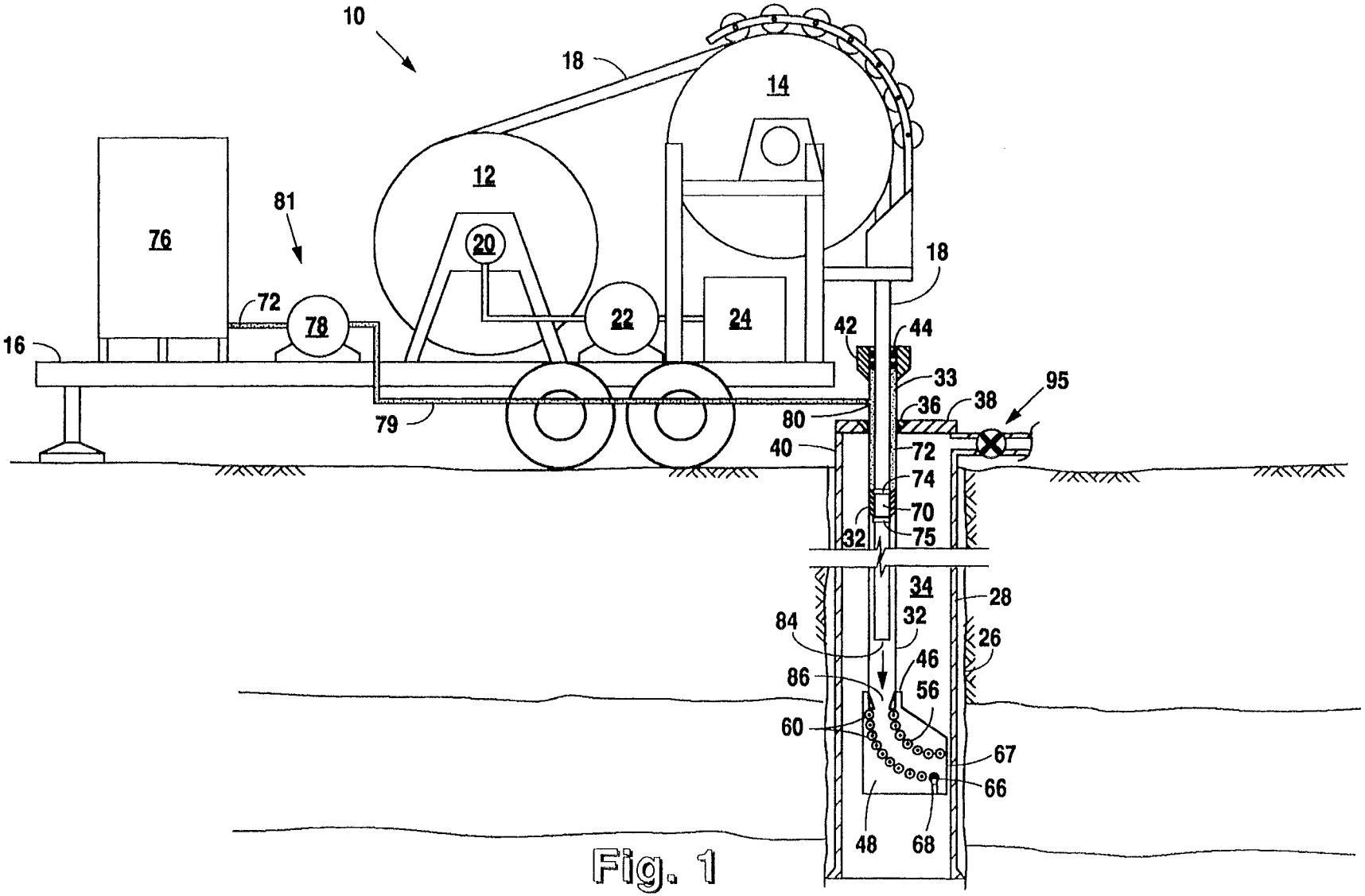
FIG. 1 illustrates the present inventive system in a first condition prior to the application of hydraulic pressure on to the coil tubing.
Figure 2:
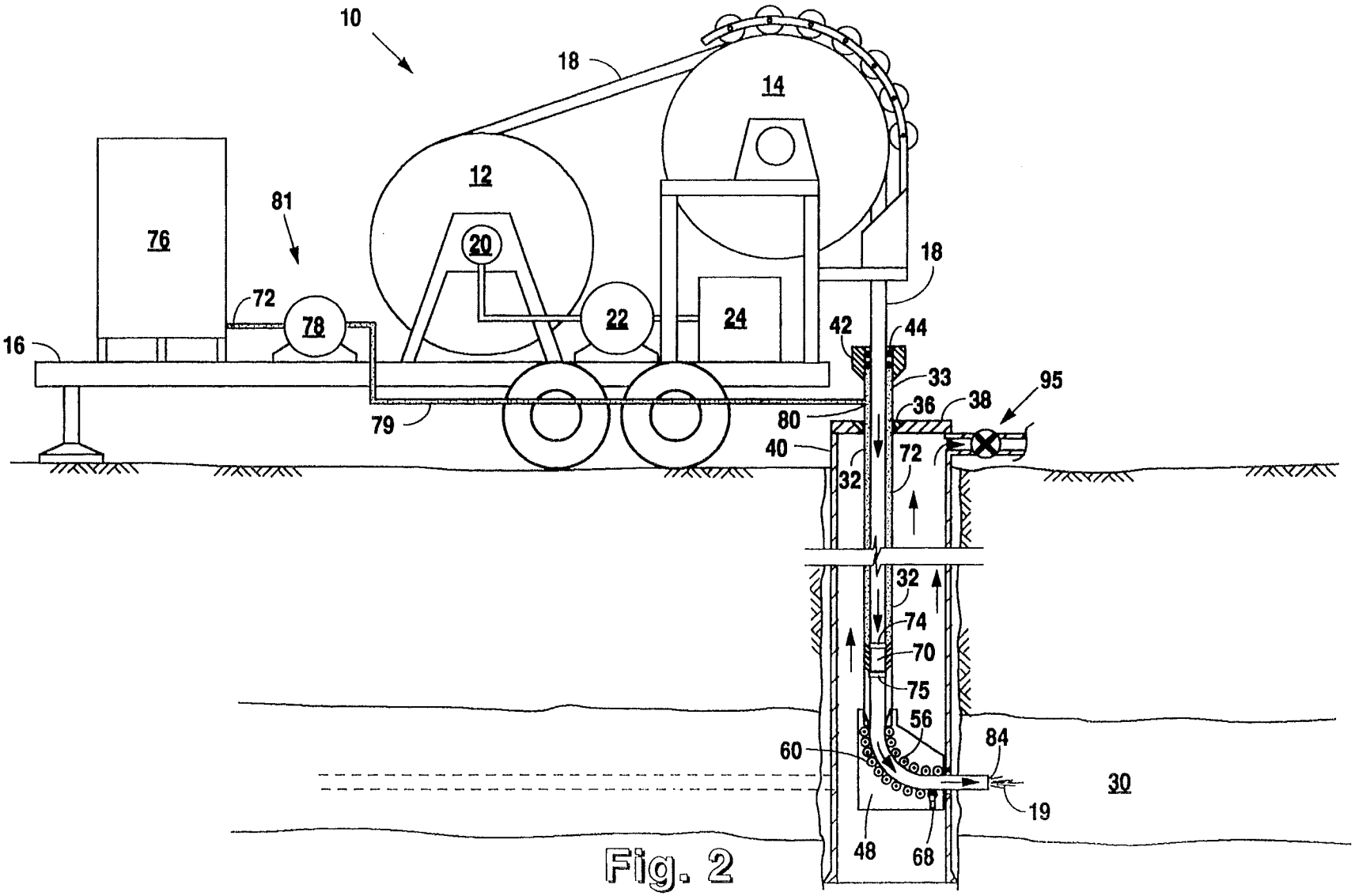
FIG. 2 illustrates the present inventive system in a second condition wherein the coil tubing has been translated and a generally horizontal bore in a subterranean formation is being formed.

FIGS. 1 and 2 illustrate the present inventive system in a first condition. A coil tubing injection system 10 incorporating a storage reel 12 and an injection reel 14 are shown mounted on a mobile trailer 16 for transport to the well site and for injection of coil tubing 18 into the well bore 26. An example of such a coil tubing injection system is disclosed in U.S. Pat. No. 4,673,035 issued to the present inventor. Although the injection system illustrated includes an injection reel and other features noted in U.S. Pat. No. 4,673,035, it should be understood that simply providing a means for allowing the coil tubing to be spooled and unspooled, run into, and withdrawn from the well bore would fall within the scope of the present invention.

The coil tubing 18 is generally a flexible but strong material composition capable of handling high internal fluid pressures. Typically, the coil tubing has an outside diameter in the range of $\frac{1}{2}''$ to $1\frac{1}{8}''$; preferably $\frac{3}{8}''$.

Coil tubing 18 is stored on reel 12 which is provided with a rotatable fluid swivel joint 20 (known in the art) which allows a fluid 19 (See FIG. 2) to be pumped through pump 22 from reservoir 24 through the coil tubing 18 while the tubing is still on the storage reel 12 and being injected into the well 26.

As is well known in the art, well 26 has a well borehole 34 and may be provided with an outer well casing 28, typically in the range of 6"–12" inside diameter, which extends downhole in the well into the production zone 30 of the well. A well borehole may not, in some cases, be provided with a casing 28. Such wells are sometimes referred to as open wells. Wells are formed by making a first generally vertical bore into the terrain and then casing the bore if the well is to be cased. Typically, a portion of the casing 28 is perforated to allow hydrocarbons or other production fluids to flow into the well borehole 34 for collection and removal to the surface.

In FIGS. 1 and 2 it may be seen that a first conduit 32 is suspended in a generally vertical orientation within the vertical borehole 34 and within casing 28. Conduit 32 may be any structure having an inside area through which coil tubing 18 may pass. In the preferred embodiment conduit 32 is the standard $2\frac{3}{8}''$ outside diameter production well tubing.

Conduit 32 is suspended inside well borehole 34 and casing 28 by means of a clamp member 36 which is tightened around the outside diameter of conduit 32 at a top section 33 of the conduit 32. Any clamping structure may be utilized which is capable of holding the conduit in place without slipping downhole. Extending outwardly from the clamping member 36 is a flange 38. Flange 38 bridges the opening of the casing and allows the clamping member 36 to be supported at the wellhead 40.

Attached at the top of conduit 32 is a top packer 42. Typical on this type of packer is a brand known as a Regal tubing striper packoff. The packer is provided with seals 44 interval to the packer. Packer 42 may be opened or closed as is well known in the art, to allow coil tubing 18 to easily slide pass the seals as coil tubing is run into the hole to the top of the bender as will be discussed below. Seals 44 ensure that hydraulic fluid 72 pumped inside conduit 32 does not escape when the packer 42 is closed as will be discussed further below.

Downhole at the lower distal end 46 of conduit 32, a coil tubing bender 48 is attached to conduit 32. Bender 48 is affixed to the end of conduit 32 at the surface and is lowered into the well borehole 34 and the casing 28 as will be further discussed. Bender 48 is a means for bending coil tubing 18 from a generally vertical orientation as shown in FIG. 1 to a generally horizontal orientation as shown in FIG. 2. Bender 48 allows for a short radius turn of coil tubing 18 at approximately 90° within approximately one foot. Where a well casing 28 is installed, the coil tubing may be translated from a vertical orientation to a horizontal orientation within six inches.

Figure 3:
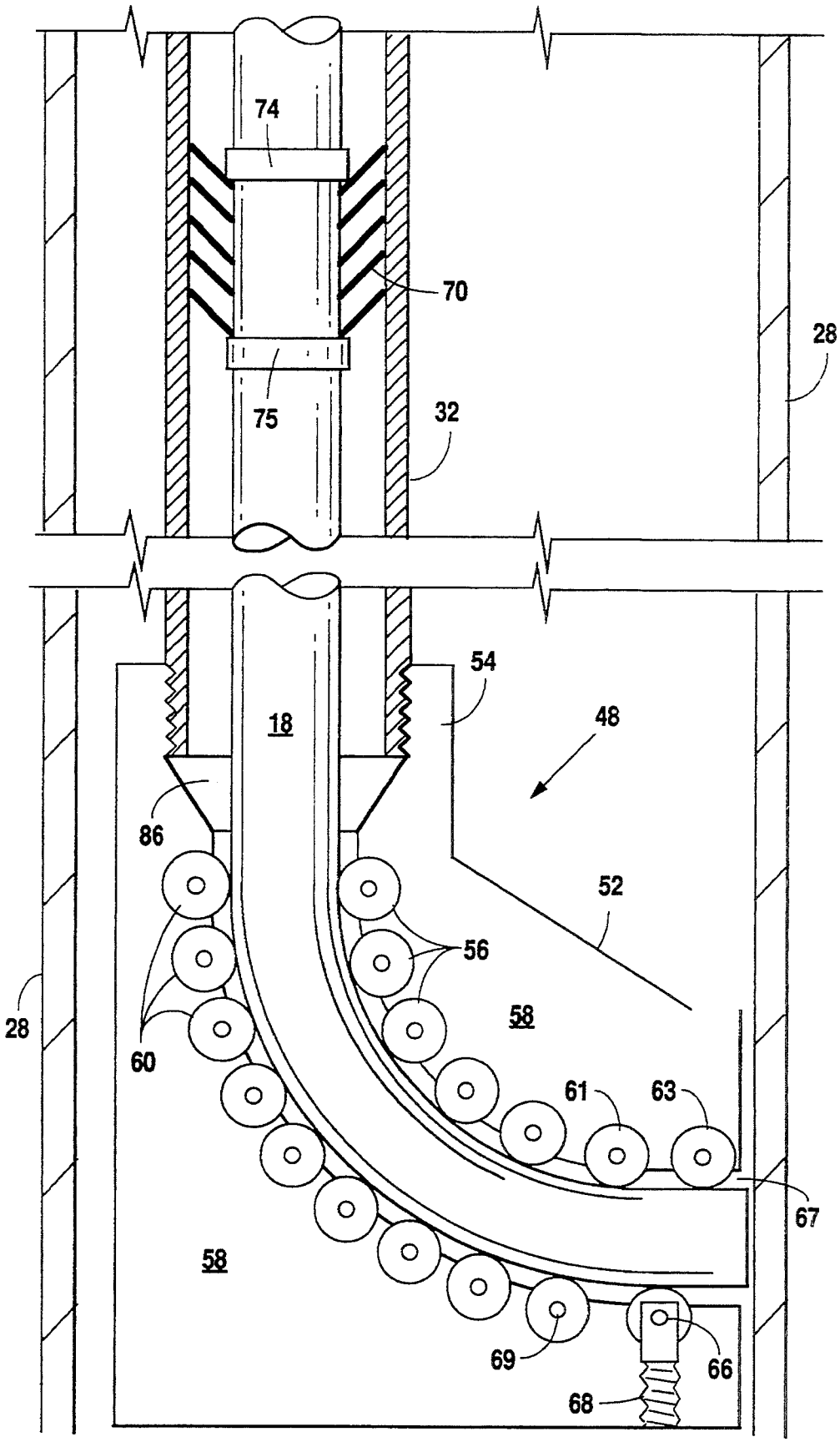
FIG. 3 illustrates the bender of the present invention.
Figure 4:
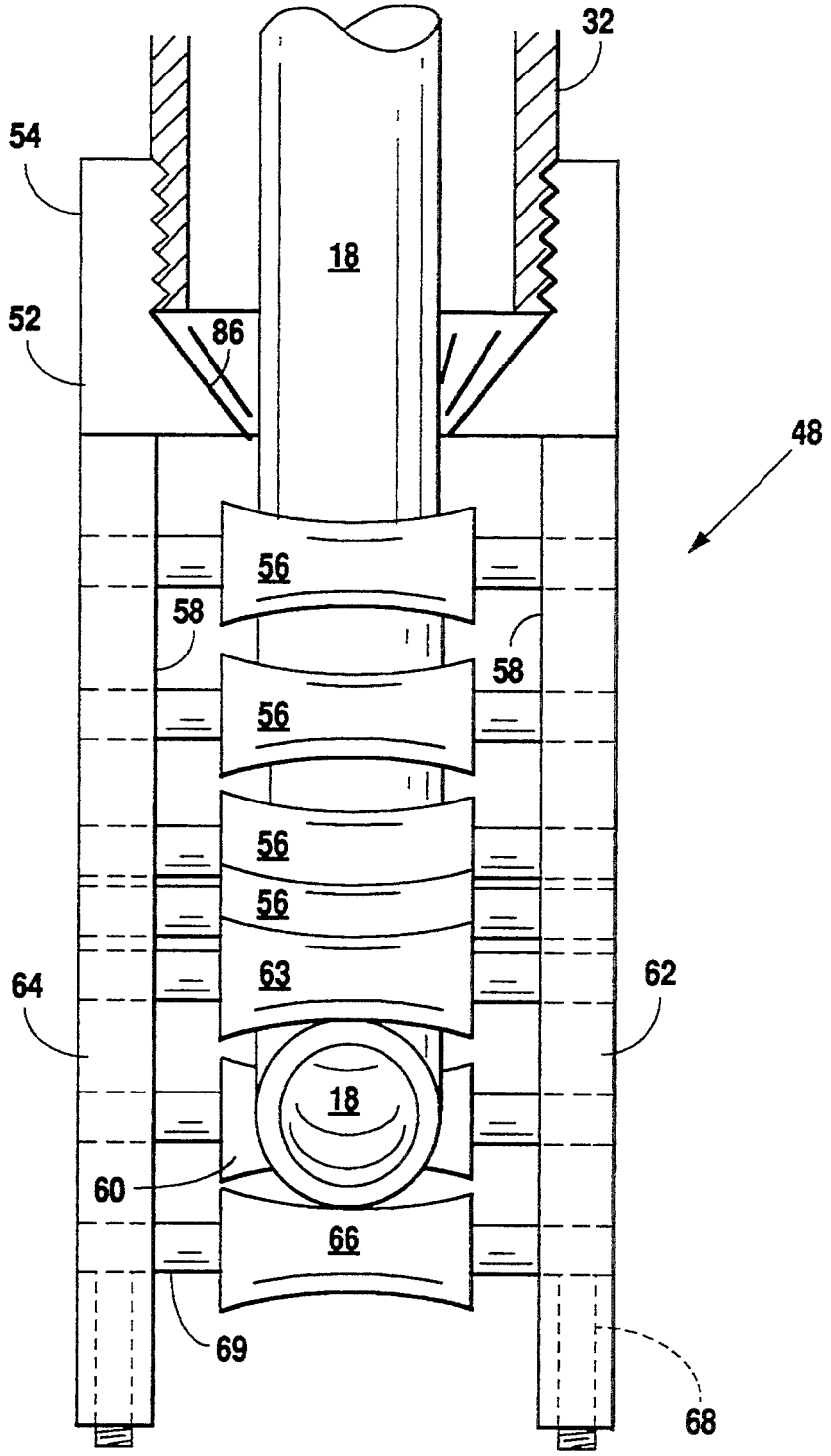
FIG. 4 illustrates a front view of the bender of the present invention.

Bender 48 is further illustrated in FIGS. 3 and 4. An outer housing 52 has an adapter neck section 54 which may be attached to the end of conduit 32 by means of a threaded coupling or welding or any other suitable means of attachment. A series or plurality of upper rollers 56 are attached through or to the inner wall 58 of housing 54 and are spaced apart from a series or plurality of lower rollers 60 also attached to the inner wall 58 of the housing 54. The distance between the upper and lower rollers is sufficient to enable coil tubing 18 to pass through the housing between the rollers and be turned from the vertical direction to the horizontal direction.

FIG. 4 illustrates a front, cross-sectional view of bender 48 threadingly attached at neck 54 to conduit 32. It should be noted that tubing 18 pass under the upper rollers 56 and over the lower rollers 60. The rollers are attached on the inside of housing 52 which has two side plates 62 and 64 for retaining the rollers in a generally fixed, spatial relationship. Each roller is provided with a shaft 67 about which the roller may rotate. At the exit 67 of the bender 48, a tubing straightener mechanism is provided. Upper rollers 61 and 63 are in the same horizontal plane and cooperate with last lower roller 66 to achieve the straightening. The last lower roller 66 is provided with a means of vertical adjustment 68 which enables the roller to be moved up or down to straighten the coil tubing 18 as it exits the bender 48. Any conventional means for adjusting the vertical location of the roller 66 may be used, such as a threaded jacking screw which is capable of moving roller shaft 67 upwardly or downwardly. It should be understood that other rollers in the bender may be provided with adjustment means as discussed above as required to facilitate the passage of coil tubing through the bender 48, and provide the desired resultant horizontal orientation of the coil tubing as it exits the bender.

FIGS. 1 and 2 further illustrate an outer coil tubing seal 70 affixed to the outer surface of the coil tubing 18. Seal 70 is positioned downhole of packer 42 and functions to prevent the escape of hydraulic fluid 72 when such fluid is pressurized between the inner surface of conduit 32 and the outer surface of coil tubing 18.

Seal 70 is retained in a fixed position around coil tubing by means of upper stop ring 74 and lower stop ring 75. Thus, when hydraulic pressure is applied to seal 70 the downward force urges the coil tubing 18 to move downwardly into and through the bender 48. The stop rings 74 and 75 ensure that the hydraulic force is transferred to the coil tubing 18 and that the seal 70 moves vertically with the coil tubing and does not slip downwardly without moving the coil tubing. Seal 70 is well known in the art and is sometimes referred to as a swab cup and acts like hydraulic cylinder seal.

The hydraulic urging of the coil tubing 18 through the bender 48 is accomplished by means of a hydraulic power supply in fluid communication with the inside of conduit 32 between coil tubing 18 and upper packer 42 and outer tubing seal 70. A reservoir 76 of hydraulic fluid 72 of sufficient volume capacity is operatively connected to a hydraulic pump 78 to enable an operator to develop a hydraulic force which is communicated to the interior of conduit 32 via a transfer line 79 sealingly connected to an opening 80 in conduit 32. The pump may be a high pressure, low volume positive displacement type pump well known in the art. The hydraulic system 81 is further provided with the necessary pressure relief, safety systems known in the art.

It should be understood that reservoir 76 and pump 78 may be mounted on easily transportable carriages and may be manually or electrically operated. A simple lever action, piston-type pump or a reciprocating piston pump could be utilized if it is capable of developing sufficient pressure with a sufficient volume of hydraulic fluid in the hydraulic system 81 to urge the coil tubing 18 down the borehole 34 inside the conduit 32 and through the bender 48.

In operation, a first vertical bore 26 is drilled into the subterranean formation. The well casing 28 may be installed as is well known. Then conduit 32 with bender 48 attached is inserted into the well borehole 34 to the desired depth with the bender exit 67 disposed in the desired direction. For example, the conduit and bender may be run to a depth of 800 feet into the production zone. The conduit 32 may be rotated to direct the exit in a due east direction as shown in FIG. 1. Once the desired depth and direction has been achieved, conduit 32 is suspended of the surface at the wellhead 40 by means of outer conduit clamping member 36 and flange 38 as discussed above. Top packer 42 is installed at the top section 33 of conduit 32. Packer 42 is opened to allow the coil tubing to easily pass through the packer.

About a 10 to 30 foot section of coil tubing is injected into the hole through packer 42 and into conduit 32. Outer coil tubing seal 70 is rigidly affixed to the outer surface of the coil tubing and held in place by upper and lower stop rings 74 and 75. After seal 70 is secured to the coil tubing, the coil tubing is further injected into conduit 32 until leading end 84 of coil tubing 18 abuts the inlet 86 of bender 48.

At this point, upper packer 42 is closed and seals 44 are sealingly engaged against the outer surface of coil tubing 18. Hydraulic system 81 is activated to pump hydraulic fluid 72 from reservoir 76 through pump 78, transfer line 79, opening 80 and into the interior of conduit 32 between packer 42 and outer coil tubing seal 70. At the same time, the coil tubing injection system 10 is arranged to allow the coil tubing to unspool from the storage reel 12 as hydraulic pressure is applied through the system 81 to the coil tubing 18.

Coil tubing 18 is urged through the bender 48, as the coil tubing passes between the upper and lower roller 56 and 60, and translated from a generally vertical orientation as it enters bender inlet 86 to a generally straightened, horizontal orientation as it exits bender exit 67.

To create a horizontal borehole in the production zone 30, abrasive fluid 19 well known in the art such as sand/water mixture is pumped from reservoir 24 at high pressures by pump 22 through joint 20, down coil tubing 18 and discharged from leading end 84. The combination of the high pressure and abrasive characteristics of the fluid 19 readily cut through the steel well casing 28, if such casing is installed, and bore into the formation's production zone 30, as may be seen if FIG. 2.

It should be understood that hydraulic pressure developed through system 81 may be continuously applied while the high pressure/abrasive fluid 19 is used to cut through the formation. In this way, a horizontal bore is created in the formation. The length of the bore may be varied by making adjustments to the position of outer coil tubing seal 70 after the initial bore is started so as to allow additional coil tubing 18 to be run through the bender and into the formation 30.

After a first horizontal bore is formed, the coil tubing may be withdrawn into the bender 48 sufficiently to allow the conduit 30 with bender 48 to be rotated within the well borehole 34; the conduit with bender rotated into a new direction, for example, 90° to the north; the coil tubing urged through the bender and the boring operation re-initiated. By this method a multiplicity of generally horizontal radial bores may be made in the formation.

As should be further recognized, a multiplicity of generally horizontal bores may be made a various depths by simply varying the depth at which the bender is placed. For example, after the coil tubing 18 is run into the formation and a first horizontal bore is formed at a first depth, the coil tubing 18 may be withdrawn into the bender 48, sufficiently to allow the conduit 32 to be raised or lowered to a second depth. The conduit 32 is suspended at the second depth; the coil tubing urged through the bender; the boring operation is again activated and an additional generally horizontal bore is formed at the second depth.

A discharge system 95 is provided at the wellhead 40 to allow excess abrasive fluid 19 to be removed from the well bore. Such a system may include valving, pumps, and catch basins as may be necessary and appropriate.

While the invention has been described in connection with a preferred embodiment, it is not intended to limit the invention to be the particular form set forth, but, on the contrary, it is intended to cover alternatives, modifications, and equivalents, as may be within the scope of the invention as defined by the appended claims.

I claim:

1. A system for translating the orientation of coil tubing from a generally vertical orientation to a generally horizontal orientation inside a well borehole and downhole of wellhead comprising:

means for suspending a first conduit inside said well borehole, said suspending means attached at a top section of said first conduit near said wellhead;

means for injecting a length of coil tubing into said first conduit;

means for bending said coil tubing from said vertical orientation to said horizontal orientation, said bending means attached to a downhole section of said first conduit; and means for hydraulically urging said coil tubing through said bending means, wherein said means for hydraulically urging said coil tubing through said bending means further comprises:

a hydraulic power source in fluid communication with an interior section of said first conduit;

an upper packer affixed to said top section of said first conduit for hydraulic sealing engagement against an outer surface of said coil tubing;

an outer coil tubing seal affixed to said outer surface of said coil tubing downhole of said upper packer, said outer coil tubing seal in hydraulic sealing engagement with an inner surface of said first conduit; and an opening in said first conduit intermediate of said upper packer and said outer coil tubing seal, said opening for hydraulic fluid in said hydraulic power source to communicate with said interior section of said first conduit between said upper packer and said outer coil tubing seal.

2. The system of claim 1 further comprising a means for supplying high pressure abrasive fluid to the inside of said coil tubing for discharge after said coil tubing is urged through said bending means.

3. The system of claim 1 wherein said means for bending said coil tubing further comprises:

an outer housing;

a means for attaching said outer housing to a downhole end of said first conduit;

a plurality of upper rollers attached to an inside section of said housing;

a plurality of lower rollers attached to said inside section;

said upper and said lower rollers spaced apart sufficiently to allow said coil tubing to pass through said housing when urged by said hydraulically urging means; and wherein said upper and said lower rollers cooperate to bend said coil tubing from said generally vertical orientation to said generally horizontal orientation.

4. The system of claim 3 wherein said means for bending further comprises a means for straightening said coil tubing as it exits said means for bending.

5. The system of claim 1 wherein said means for suspending said first conduit further comprises:

a clamp member releasably secured to an outer surface of said first conduit at said top section; and an outwardly extending flange secured to said clamp member and mountable to said wellhead.

6. The system of claim 1 wherein said hydraulic power source further comprises:

a high pressure, low volume pump in fluid communication with said opening; and a hydraulic fluid reservoir in fluid communication with said pump.

7. The system of claim 6 wherein said high pressure, low volume pump is a reciprocating piston pump.

8. A method for forming a horizontal bore into a subterranean formation comprising:

drilling a first generally vertical bore into said subterranean formation;

inserting and suspending into said first bore at a first depth, a first conduit, said conduit having a bender on a downhole end of said conduit;

injecting a length of coil tubing into said first conduit;

hydraulically urging said coil tubing through said bender by means of an urger to translate said coil tubing from a generally vertical orientation to a generally straightened, horizontal orientation within said first generally vertical bore, said urger further comprising:

a hydraulic power source in fluid communication with an interior section of said first conduit;

an upper packer affixed to a top section of said first conduit for hydraulic sealing engagement against an outer surface of said coil tubing;

an outer coil tubing seal affixed to said outer surface of said coil tubing downhole of said upper packer, said outer coil tubing seal in hydraulic sealing engagement with an inner surface of said first conduit; and an opening in said first conduit intermediate of said upper packer and said outer coil tubing seal, said opening for hydraulic fluid in said hydraulic power source to communicate with said interior section of said first conduit between said upper packer and said outer coil tubing seal; and activating a means for discharging a boring fluid through said coil tubing to form said horizontal bore in said formation.

9. The method of claim 8 further comprising:

feeding additional coil tubing into said first conduit; and continuing to apply hydraulic pressure on said coil tubing while forming said horizontal bore in said formation.

10. The method of claim 8 further comprising:

deactivation of said discharging means forming said horizontal bore;

withdrawing said coil tubing into said bender sufficiently to allow said conduit to be moved at a second depth within said first bore;

moving said conduit to said second depth;

hydraulically urging said coil tubing to exit said bender; and reactivating said discharge means to form a second horizontal bore in said formation at said second depth.

11. The method of 8 further comprising: deactivation of said discharge means forming said horizontal bore;

withdrawing said coil tubing into said bender sufficiently to allow said conduit to be rotated to a second horizontal direction within said first bore;

rotating said conduit to said second horizontal direction;

hydraulically urging said coil tubing to exit said bender; and reactivating said discharge means to form a second horizontal bore in said formation in said second horizontal direction.

* * * * *